US011655068B2

(12) United States Patent
Pruvost

(10) Patent No.: US 11,655,068 B2
(45) Date of Patent: May 23, 2023

(54) CONSTRUCTION PANEL, ASSOCIATED KIT AND ASSOCIATED MODULAR OBJECT

(71) Applicant: Julien Pruvost, Saint Jean la Bussière (FR)

(72) Inventor: Julien Pruvost, Saint Jean la Bussière (FR)

( * ) Notice: Subject to any disclaimer, the term of this patent is extended or adjusted under 35 U.S.C. 154(b) by 242 days.

(21) Appl. No.: 17/125,224

(22) Filed: Dec. 17, 2020

(65) Prior Publication Data

US 2021/0188480 A1 Jun. 24, 2021

(30) Foreign Application Priority Data

Dec. 18, 2019 (FR) ..... 1914727

(51) Int. Cl.
*B65D 6/24* (2006.01)
*E04B 1/00* (2006.01)
*B65D 21/08* (2006.01)

(52) U.S. Cl.
CPC ..... *B65D 11/1873* (2013.01); *B65D 21/083* (2013.01); *E04B 1/00* (2013.01)

(58) Field of Classification Search
CPC ..... B65D 11/1873; B65D 11/10; B65D 11/18; B65D 11/1806; B65D 11/1833; B65D 11/1846; B65D 11/186; B65D 11/1866; B65D 21/083; B65D 7/24; B65D 7/06; B65D 7/12; B65D 7/26; B65D 7/28; B65D 7/30; B65D 7/32; B65D 9/06; B65D 9/12; B65D 9/14; B65D 9/18; B65D 9/22; B65D 9/24; B65D 15/24; B65D 2313/04;
(Continued)

(56) References Cited

U.S. PATENT DOCUMENTS 343,588 A * 6/1886 Lewis ..... B65D 9/14 312/265.5
1,138,643 A * 5/1915 Dunlap ..... B65D 7/26 292/213
(Continued)

FOREIGN PATENT DOCUMENTS

CN 85 1 04264 5/1986
EP 1 660 314 5/2006
(Continued)

OTHER PUBLICATIONS

Search Report and Written Opinion for FR Application No. 1914727 dated Sep. 11, 2020, 8 pages.

*Primary Examiner* — Kyle J. Walraed-Sullivan
(74) *Attorney, Agent, or Firm* — Nixon & Vanderhye

(57) ABSTRACT

The present invention relates to a construction panel (1), said panel (1) having a polygonal shape, each of the edges of the panel (1) having, over its entire length, a crenelated pattern (2) which is made up of at least two protrusions (3) in each of which a longitudinal through bore (4) is arranged, wherein a sliding locking device (5) is positioned in each longitudinal through bore (4) of the panel (1), said sliding locking device (5) being able to assume one of an unlocked position in which the sliding locking device (5) is completely located inside the associated longitudinal through bore (4) and a locked position in which the sliding locking device (5) partially leaves the associated longitudinal through bore (4).

15 Claims, 11 Drawing Sheets

(58) Field of Classification Search
CPC ..... E04B 1/6141; E04B 1/6162; E04B 2002/0245; E04B 2002/0247
USPC ..... 220/4.28, 4.33
See application file for complete search history.

(56) References Cited

U.S. PATENT DOCUMENTS 1,198,524 A * 9/1916 Cunliffe ..... B65D 7/26 220/6
1,608,702 A * 11/1926 Lindblom ..... B65D 9/12 217/65
2,005,159 A * 6/1935 Osgood ..... B65D 9/32 217/12 A
3,116,847 A * 1/1964 Collins ..... B65D 9/22 119/513
3,537,687 A * 11/1970 Adelman ..... E02D 29/0266 47/33
3,564,112 A * 2/1971 Algotsson ..... H02B 1/40 361/641
3,692,201 A * 9/1972 Garduna ..... B65D 9/34 217/65
3,885,845 A * 5/1975 Krieks ..... A47B 47/042 312/257.1
4,169,639 A * 10/1979 Zola ..... A47B 47/04 297/440.13
4,266,670 A * 5/1981 Mykleby ..... B65D 5/445 217/65
4,461,395 A * 7/1984 Burnett ..... B65D 11/1873 217/65
4,789,075 A * 12/1988 Sun ..... B65D 11/1846 206/508
4,823,858 A * 4/1989 Perutz ..... E04B 2/7405 16/366
5,033,161 A * 7/1991 Chavez ..... B25B 27/04 16/262
5,107,652 A * 4/1992 Sosa ..... E04C 1/395 52/586.1
5,168,678 A * 12/1992 Scott, Jr. ..... E04C 1/395 47/33
5,490,604 A * 2/1996 Alexander ..... B65D 11/1873 220/676
5,931,326 A * 8/1999 Weng ..... B65D 9/12 220/4.28
6,216,899 B1 * 4/2001 Vicari ..... B65D 19/16 206/600
6,631,821 B2 * 10/2003 Vourganas ..... B65D 19/18 206/600
6,854,221 B1 * 2/2005 Michaels ..... E02D 29/025 52/585.1
7,165,821 B2 * 1/2007 Chuan ..... A47B 47/042 312/348.4
7,185,778 B1 * 3/2007 Palley ..... B65D 88/14 220/692
7,478,734 B2 * 1/2009 Vargas ..... B65D 7/24 220/668
7,744,161 B2 * 6/2010 Berg ..... A47C 4/03 297/440.16
7,909,000 B1 * 3/2011 O'Neill ..... A01K 5/01 220/4.33
8,147,012 B2 * 4/2012 Green ..... A47B 88/941 312/265.5
8,181,806 B2 * 5/2012 Hidalgo Vargas ..... B65D 11/1833 220/4.28
9,676,515 B2 * 6/2017 Huggett ..... B65D 19/16
9,714,113 B2 * 7/2017 Jung ..... B65D 71/04
D827,863 S * 9/2018 Walter ..... D25/113
10,689,155 B2 * 6/2020 Sullivan ..... B65D 11/1873
10,940,976 B2 * 3/2021 Goddard ..... B65D 19/18
2005/0212391 A1 * 9/2005 Chuan ..... A47B 88/9412 312/348.2
2006/0237455 A1 * 10/2006 Vargas ..... B65D 11/1873 220/4.34
2007/0056966 A1 * 3/2007 Nguyen ..... B65D 11/1873 220/4.28
2008/0263986 A1 * 10/2008 Cables ..... E04C 1/395 52/574
2009/0134057 A1 * 5/2009 Hidalgo Vargas ..... B65D 11/1833 206/600
2015/0048082 A1 * 2/2015 Galal ..... B65D 21/083 220/4.12
2018/0186511 A1 * 7/2018 Sullivan ..... B65D 21/02
2018/0328030 A1 * 11/2018 Walter ..... E04B 2/18
2020/0190837 A1 * 6/2020 Xia ..... E04H 1/1205
2021/0188480 A1 * 6/2021 Pruvost ..... B65D 11/1873
2021/0237931 A1 * 8/2021 Prieschl ..... B65D 77/06
2021/0261288 A1 * 8/2021 Karsten ..... B65D 15/22
2022/0173579 A1 * 6/2022 Nolen ..... H02G 9/10

FOREIGN PATENT DOCUMENTS

WO 2004/074593 9/2004
WO 2005/021391 3/2005
WO 2017/109592 6/2017

* cited by examiner

CONSTRUCTION PANEL, ASSOCIATED KIT AND ASSOCIATED MODULAR OBJECT

This application claims priority to FR Patent Application No. 1914727 filed Dec. 18, 2019, the entire contents of each of which are hereby incorporated by reference.

The present invention relates to the field of modular objects, and in particular relates to a construction panel, an associated kit and an associated modular object.

Packaging items are three-dimensional objects intended to contain and protect goods so as to store and/or transport the goods.

Different types of packaging items exist, such as cardboard boxes associated with stretch film, plastic bins, cardboard bins and custom bins for specific products. However, these existing packages are not modular based on the products that they contain, such that these existing packages are generally too large relative to the contained products, which does not allow optimal packaging of the stored and/or transported products.

European patent application EP1660314A1 discloses a packaging made up of several panels each having crenelated edges, each ridge of the packaging being formed by interconnecting two crenelated edges of two separate panels, then introducing a rod into through bores arranged in the two interconnected crenelated edges. However, the assembly and disassembly of this packaging is not easy. Indeed, the user must insert a rod over the entire length of each ridge during the assembly of the packaging, and must fully remove each rod during the disassembly of the packaging. Furthermore, the locking means, that is to say the rods, of this packaging are not integrated into the panels, such that there is a risk of losing these rods when the packaging is not assembled.

Chinese patent application CN85104264A discloses a packaging made up of several packaging panels with a convex polygonal shape having crenelated edges in which through bores are arranged, sliding latches being positioned in some of these through bores to allow the locking of two interconnected crenelated edges of two different panels. However, during the assembly of this packaging, the user must push all of the sliding latches one by one to allow the locking of the ridges of the packaging, which makes the assembly of the packaging very tedious. Likewise, during the disassembly of the packaging, the user must push all of the sliding latches one by one in the opposite direction to allow the unlocking of the ridges of the packaging, which makes the disassembly of the packaging very tedious as well.

The present invention aims to address the drawbacks of the prior art, by proposing a construction panel having a convex polygonal shape, each of the edges of which has a battlement or crenelated pattern made up of at least two protrusions each comprising a longitudinal through bore in which a sliding locking device is positioned. A modular three-dimensional object, such as a modular packaging item, a modular furniture item or a modular partition, can thus be formed by interconnecting the edges of several panels two by two, the sliding locking devices integrated into all of the protrusions of the panels allowing very easy locking/unlocking of the interconnections of the panels.

The present invention therefore relates to a construction panel, said panel having a convex polygonal shape, each of the edges of the panel having, over its entire length, a crenelated pattern which is made up of at least two protrusions in each of which a longitudinal through bore is arranged, wherein a sliding locking device is positioned in each longitudinal through bore of the panel, said sliding locking device having a length which is identical to that of the associated longitudinal through bore and being able to assume one of an unlocked position in which the sliding locking device is completely withdrawn inside the associated longitudinal through bore and a locked position in which the sliding locking device partially leaves the associated longitudinal through bore, wherein, for each edge of the panel, the sliding locking devices of the corresponding crenelated pattern are configured to slide in the same direction to pass from the unlocked position to the locked position, such that, when one of the crenelated patterns of the panel is interconnected with a complementary crenelated pattern of an edge of another panel, during the passage to the locked position, each sliding locking device of said crenelated pattern is configured to partially withdraw into the longitudinal through bore of the adjacent protrusion of said other panel and to push the sliding locking device of said adjacent protrusion of said other panel.

Thus, a modular object, such as a packaging item, a furniture item or a partition, can be formed by interconnecting the crenelated edges of several panels two by two.

In case the modular object is a package, the modularity of the package allows extremely close packaging of the products which are stored and/or transported, in order to save space and for optimal packaging of fragile or non-fragile solid products.

The panels according to the invention can also be used in the field of furniture and construction so as to build furniture items or partitions.

The sliding locking devices, which are integrated directly into the panels, allow the interconnections of the panels to be easily locked/unlocked.

Indeed, in order to lock the interconnection of two panels, it suffices to push the sliding locking device located at one of the ends of said interconnection so as to drive the sliding of all of the sliding locking devices of said interconnection, each sliding locking device entering the adjacent protrusion of said interconnection and pushing the adjacent locking device, which makes it possible to greatly facilitate the locking of the interconnection by the user. Therefore, the sliding locking devices of all of the protrusions of a same crenelated edge have their locking position on a same side of the panel.

Identically, to unlock the interconnection of the two panels, the user must simply push the sliding locking device located at the other end of said interconnection so as to drive the sliding, in the opposite direction, of all of the sliding locking devices of said interconnection, each sliding locking device then fully withdrawing into its own protrusion, which makes it possible to greatly facilitate the unlocking of the interconnection by the user.

Since the sliding locking devices of a same crenelated pattern are configured to slide in the same direction to go from the unlocked position to the locked position, all of the sliding locking devices of one edge interconnected with the edge of another panel can thus be moved simultaneously by a single operator gesture, thus preventing a multitude of locking actions.

According to one particular feature of the invention, said panel has a square or rectangular shape, the height of the at least two protrusions of each crenelated pattern being equal to the thickness of the panel.

Thus, the square or rectangular shape of the panels makes it possible for example to produce modular packaging items in a bin shape.

Different panel dimensions are possible depending on the products to be transported and/or stored.

As an example, the panels could have a square shape of 20 cm×20 cm or 40 cm×40 cm, or a rectangular shape of 20 cm×40 cm.

The panels thus make it possible to form all types of packaging items, furniture items or partitions having different sizes and shapes.

According to one particular feature of the invention, the at least two protrusions of each crenelated pattern are fixed removably to the corresponding edge of the panel.

Thus, the protrusions can be assembled on the edges of the panel, then fixed by screwing, riveting or gluing. Thus, only the protrusions can be made by plastic injection, which makes it possible to reduce the manufacturing costs of the panel. According to one particular feature of the invention, each crenelated pattern protrusion has a retaining mechanism which is configured to retain the sliding locking device in one of the unlocked position and the locked position.

Thus, the retaining mechanism makes it possible to prevent the movement of the sliding locking device in the associated protrusion, so as to guarantee that the sliding locking device stays in the unlocked position or in the locked position, when the sliding locking device is not stressed. According to one particular feature of the invention, each sliding locking device comprises an elongated body which is able to slide in the longitudinal through bore of the associated protrusion, said elongated body comprising a first end carrying a first metal element and a second opposite end carrying a second metal element, the sliding locking device further comprising a rod extending axially from the first end of the elongated body, the retaining mechanism being an annular magnet positioned fixedly in the longitudinal through bore of the associated protrusion and passed through by said rod, such that, in the unlocked position, the elongated body is located entirely in the longitudinal through bore of the associated protrusion and the first metal element carried by the first end of the elongated body is in contact with the annular magnet, and in the locked position obtained by pushing said rod toward the inside of the longitudinal through bore, the second end of the elongated body is located outside the longitudinal through bore of the associated protrusion and the second metal element carried by the second end of the elongated body is configured to be in contact with the annular magnet of the longitudinal through bore of the adjacent protrusion of another panel which is interconnected with said panel.

Thus, the magnet positioned in the protrusion makes it possible either to keep the sliding locking device of said protrusion in the unlocked position, or to keep the second end of an adjacent sliding locking device of another panel in the locked position.

It should be noted that the magnet must be designed so as to no longer keep retained the sliding locking device when the sliding locking device is stressed by being pushed by the user or by another sliding locking device.

The first and second metal elements carried by the first and second ends of the elongated body can, for example, be metal washers.

When all of the sliding locking devices of an interconnection of two panels of the modular object are in the unlocked position (that is to say when the first end of each elongated body is retained by the magnet of the associated protrusion), in order to lock said interconnection, the user must push the rod of the sliding locking device located at one of the ends of said interconnection, such that the second end of each elongated body will enter the adjacent protrusion of the interconnection and will be retained by the magnet of the adjacent protrusion, except for the second end of the last elongated body, which will leave the protrusion and will thus be accessible by the user.

The user will then simply need to press on this accessible second end of the last elongated body in order to unlock the interconnection of the two panels of the modular object.

It should be noted that the retaining mechanism could also be a pin, without departing from the scope of the present invention.

According to one particular feature of the invention, the sliding locking device further comprises a stop positioned fixedly in the longitudinal through bore of the associated protrusion, at a peripheral recess arranged in the elongated body so as to limit the travel of the elongated body in the longitudinal through bore.

Thus, the stop makes it possible to prevent the elongated body from completely leaving its protrusion in the unlocked position.

According to one particular feature of the invention, the sliding locking device further comprises a cylinder fitted in the longitudinal through bore of the associated protrusion, said cylinder containing the annular magnet at one of its ends and being flared at the other of its ends.

Thus, positioning the magnet at one of the ends of the cylinder makes it possible to fix the position of the magnet in the longitudinal through bore of the protrusion, said end of the cylinder which carries the magnet being positioned inside the longitudinal through bore, the length of the cylinder being identical to the length of the rod of the sliding locking device.

The other end of the cylinder is positioned at one of the ends of the longitudinal through bore of the protrusion, and is flared so as to facilitate the introduction into the cylinder of the second end of the elongated body of another sliding locking device in the locked position.

According to one variant of the present invention, each sliding locking device comprises a movable rod whose length is identical to that of the longitudinal through bore of the associated protrusion, the retaining mechanism being a first annular magnet positioned fixedly in the longitudinal through bore of the associated protrusion and passed through by said movable rod, a second annular magnet being mounted slidingly on said movable rod, the end of the movable rod on the side of the second annular magnet being flared so as to prevent the disengagement of the second annular magnet, the sliding locking device further comprising a stop positioned fixedly in the longitudinal through bore of the associated protrusion so as to limit the travel of the second annular magnet in the longitudinal through bore, the movable rod carrying a stop washer which is located between the stop and the first annular magnet so as to limit the travel of the movable rod in the longitudinal through bore, such that, in the unlocked position, the movable rod is located entirely in the longitudinal through bore of the associated protrusion, the stop washer is abutting against the first annular magnet and the second annular magnet is sandwiched between the flared end of the movable rod and the stop, and in the locked position, the stop washer is against the stop and at least part of the second annular magnet is located outside the longitudinal through bore of the associated protrusion and is configured to be attracted, by magnetic attraction, by the first annular magnet of the longitudinal through bore of the adjacent protrusion of another panel which is interconnected with said panel.

Thus, the first annular magnet positioned in the protrusion makes it possible either to keep the sliding locking device of said protrusion in the unlocked position by contact of the stop washer of the movable rod against the first annular magnet, or to keep the second annular magnet of the adjacent sliding locking device of the adjacent protrusion of another panel in the locked position.

The sliding locking device of this variant of the present invention thus makes it possible to obtain automatic linear locking by magnetic attraction. When the protrusions of two crenelated edges of two panels are interconnected, the second annular magnets are automatically attracted by the first annular magnets of the following protrusions and come into contact against them, the second annular magnets also moving their associated movable rods during their movement. The second annular magnet of the last protrusion of the interconnection remains immobile given that it does not have an adjacent first annular magnet, the movable rod of the last protrusion in turn partially leaving its protrusion by being pushed by the movable rod of the preceding protrusion. The locking is permanent until human intervention through pressure on the movable rod of the last protrusion of the interconnection.

The second annular magnets only come out if the following protrusions of the interconnection (that is to say, the adjacent first annular magnets) are present, which is not the case for the movable rod of the last protrusion of the interconnection that will serve as return rod and will come out to allow the unlocking of the interconnection.

It should be noted that the locking devices could also be pneumatic, hydraulic or even electric locks, without departing from the scope of the present invention.

According to one particular feature of the invention, the panel has at least one opening arranged in its thickness.

The at least one opening preferably has a square shape (for example, 14 cm×14 cm) or a rectangular shape.

According to one particular feature of the invention, the panel further comprises at least one fastening element positioned around the at least one opening and configured to allow the fastening of a covering facing the at least one opening.

Thus, the at least one opening can be filled using a covering fixed on the panel using the at least one fastening element.

The at least one fastening element can for example be at least one adhesive strip, such as a strip with hooks and loops (Velcro® strip). In this case, the at least one opening is preferably rimmed so as to allow the at least one adhesive strip to be affixed.

The covering can for example be at least one from among a protective foam, a plastic plate, a cardboard plate, a plexiglass plate and an information signage plate. The covering can also comprise a digital interface.

According to one particular feature of the invention, the panel is made from at least one material from among plastic, such as acrylonitrile-butadiene-styrene (ABS) plastic, polystyrene or polyethylene terephthalate (PET), metal, such as aluminum or steel, wood and cardboard.

The present invention also relates to a kit for building a modular object, comprising a plurality of construction panels as described above.

Thus, the kit makes it possible to build a modular object by interconnecting the edges of several panels two by two so as to form the ridges of the modular object, the sliding locking devices integrated into the panels making it possible to lock/unlock the ridges of the modular object easily.

Thus, in case of a packaging-type modular object, the user can choose the shape and the dimensions of the packaging based on the stored and/or transported product(s).

According to one particular feature of the invention, the kit further comprises at least one additional connecting part which is arranged to be inserted into adjacent crenelated patterns of two adjacent panels so as to allow the assembly of the two adjacent panels in the same plane, the at least one additional connecting part having two parallel longitudinal through bores each comprising a sliding locking device.

Thus, the at least one additional connecting part, which preferably has a cubic or parallelepipedal shape, can be inserted between two crenelated patterns so as to join together two panels of the kit in the same plane, the at least one additional connecting part having two sliding locking devices so as to allow its locking between said two panels.

According to one particular feature of the invention, the at least one additional connecting part further has a third longitudinal through bore which is perpendicular to the two parallel longitudinal through bores, said third longitudinal through bore comprising a sliding locking device.

Thus, when the additional connecting part is inserted between two facing first crenelated patterns of two panels in the same plane, the sliding locking device of the third longitudinal through bore of the additional connecting part can be used to lock two adjacent second crenelated patterns of the two panels, the two second crenelated patterns being perpendicular to the two first crenelated patterns.

According to one particular feature of the invention, the kit further comprises at least one additional junction part which is arranged to nest inside two adjacent edges with no protrusion of two adjacent panels, so as to allow the assembly of the two adjacent panels in the same plane.

Thus, when two facing edges of two panels in the same plane have no protrusion, the additional junction part can be nested, then fixed inside said two edges with no protrusion, so as to form a larger panel.

Preferably, one of the ends of the additional junction part has a longitudinal through bore comprising a sliding locking device which can be used to lock two adjacent edges with crenelated pattern of the two panels, said two edges with crenelated pattern being perpendicular to the two edges with no protrusion.

According to one particular feature of the invention, the kit further comprises at least one additional corner part comprising two adjacent faces each including a crenelated pattern made up of at least two protrusions in each of which a longitudinal through bore is arranged in which a sliding locking device is positioned, such that each of said two faces with crenelated pattern of the at least one additional corner part is configured to interconnect with a complementary edge with crenelated pattern of a panel, so as to form a corner connection of two panels.

Thus, the additional corner part has two rows of protrusions on two adjacent faces that are able to interconnect with two complementary crenelated patterns of two panels, so as to form a ridge between two panels that are inclined relative to one another. Preferably, the additional corner part makes it possible to form a 90° angle between the two panels.

Preferably, sealing gaskets are positioned on the additional corner parts, so as to seal the container formed using the kit.

The present invention further relates to a modular object, such as a modular packaging item, a modular furniture item or a modular partition, built using a kit as described above.

Thus, the user will be able to use the kit to build a modular object having a shape that is appropriate for its use. The modular object will for example have a bin shape in the packaging field, a furniture item shape in the furniture field, or a partition shape in the construction field.

Thus, the user will be able to use the kit to build a modular packaging item having an appropriate shape for optimal wrapping of the product(s) that he wishes to store and/or transport.

To better illustrate the subject matter of the present invention, preferred embodiments are described hereinafter as a non-limiting illustration in reference to the appended drawings.

Figure 1:
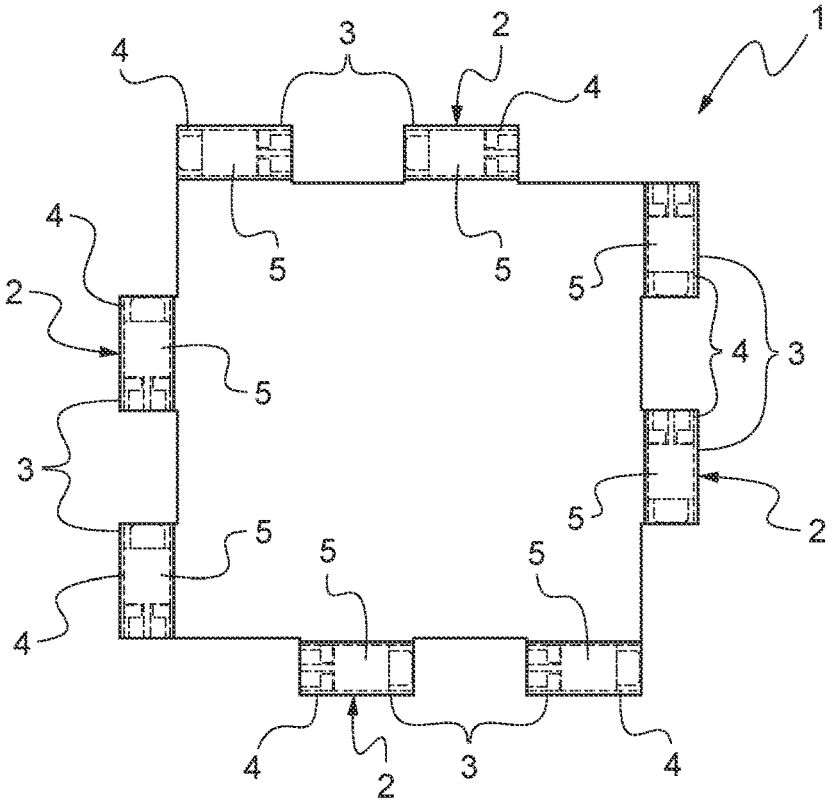
FIG. 1 is a front view of a panel according to a first embodiment of the present invention, when the sliding locking devices of the panel are in the unlocked position.
Figure 5A:
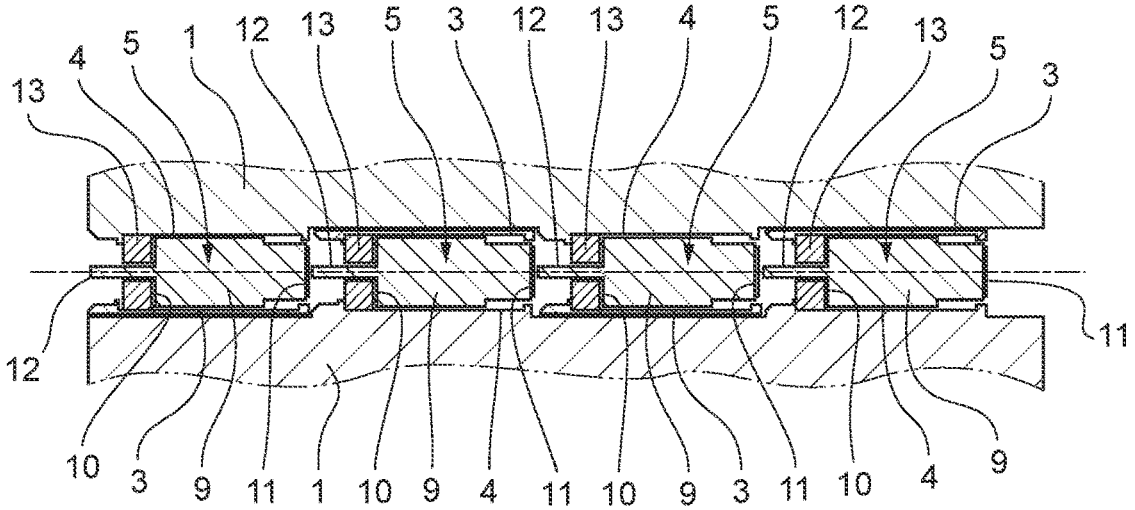
Figure 5B:
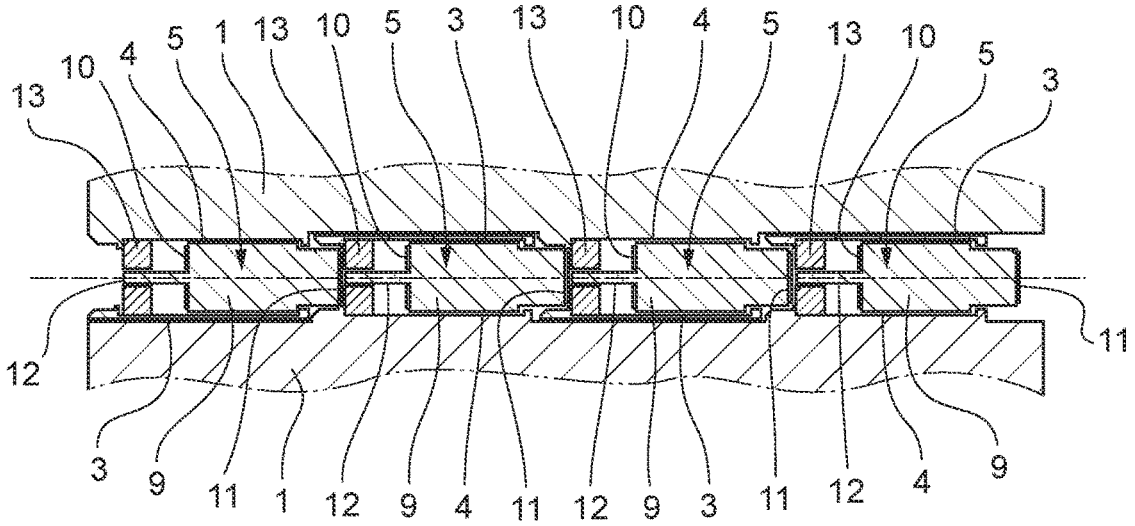
Figure 6:
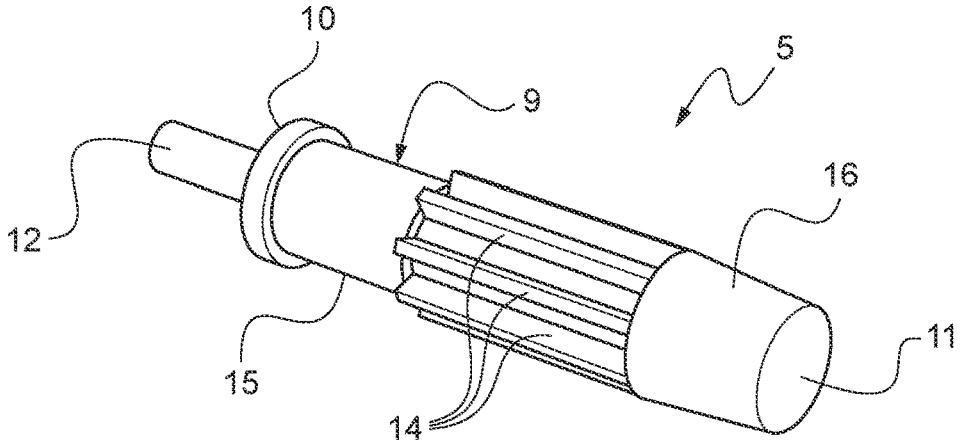
Figure 7:
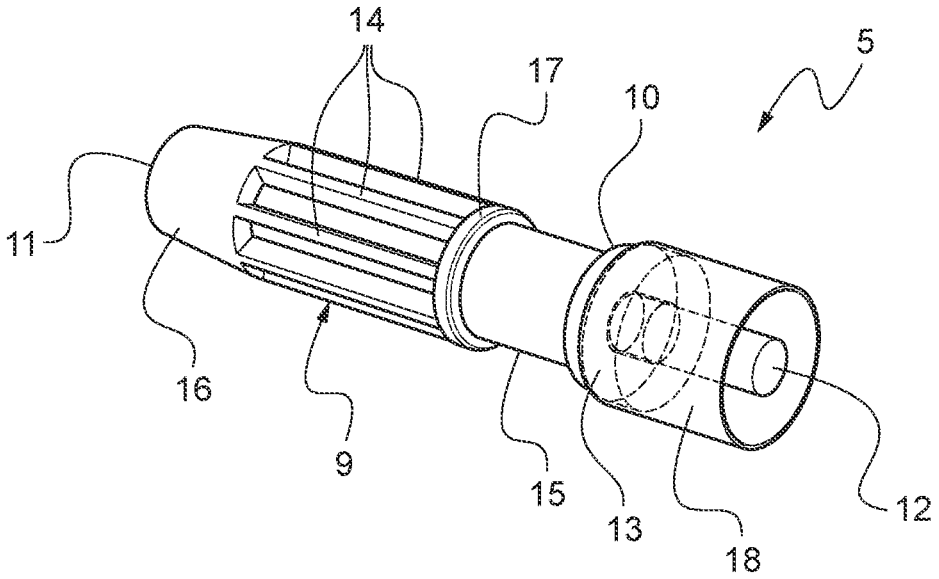
Figure 8:
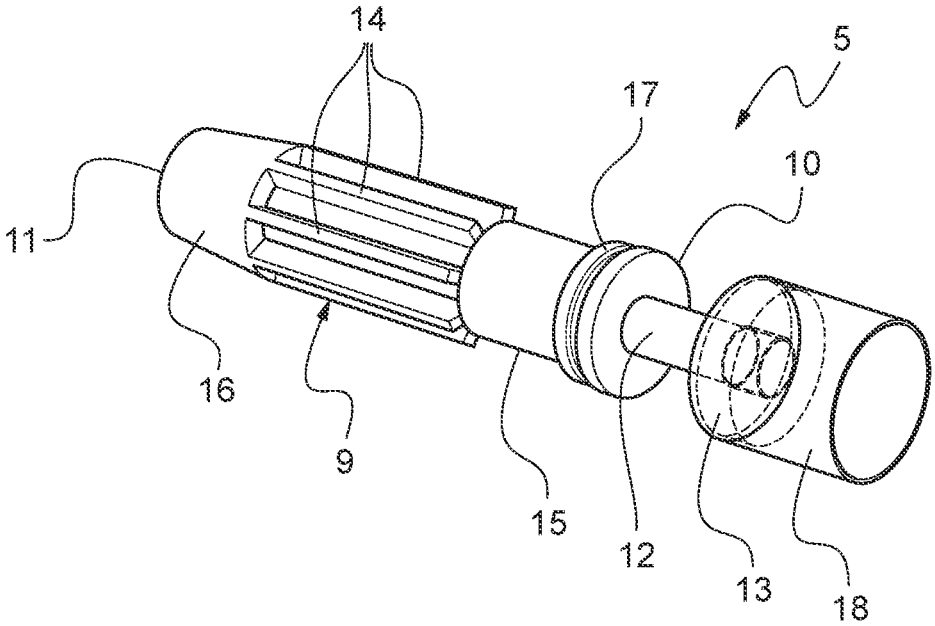
Figure 9:
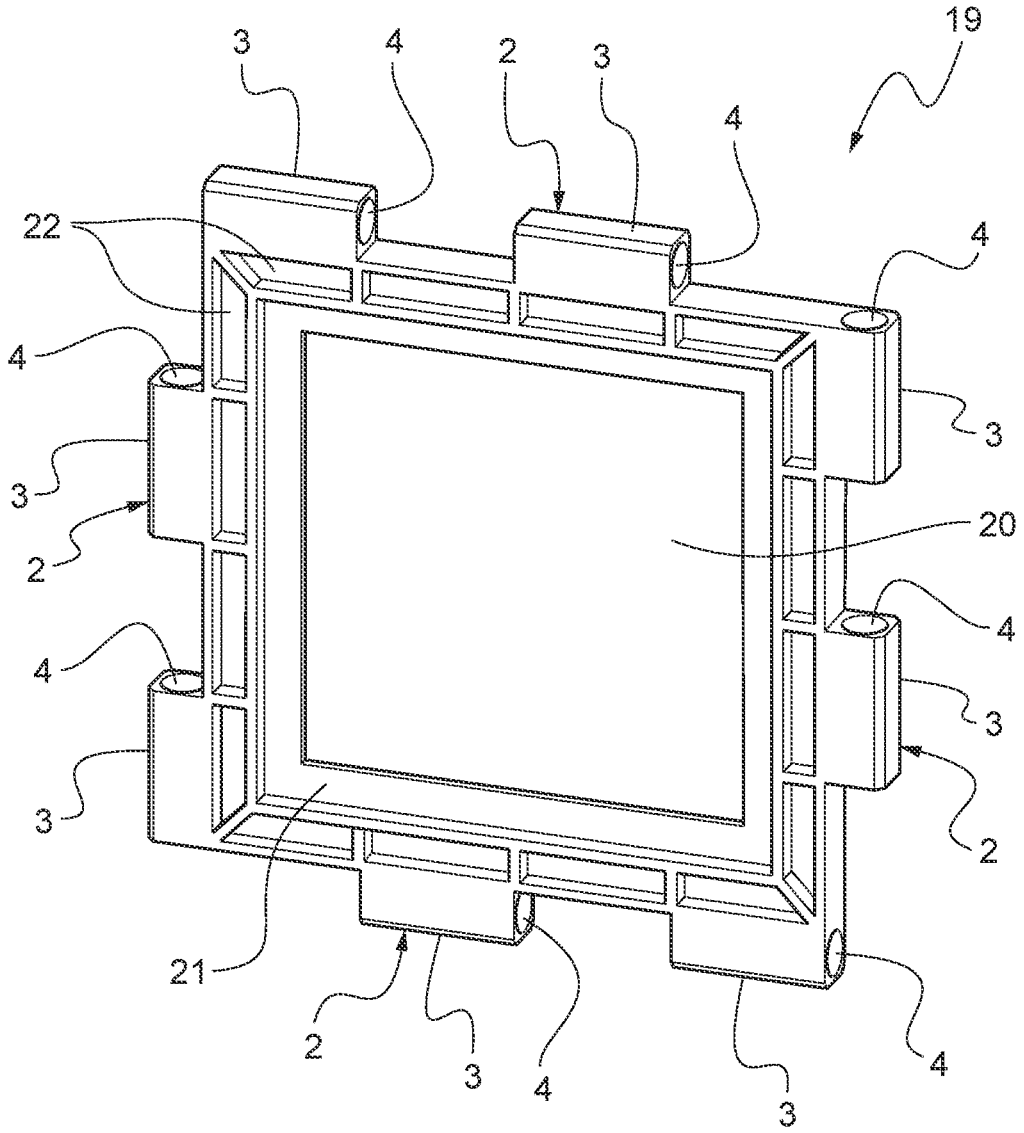
Figure 10:
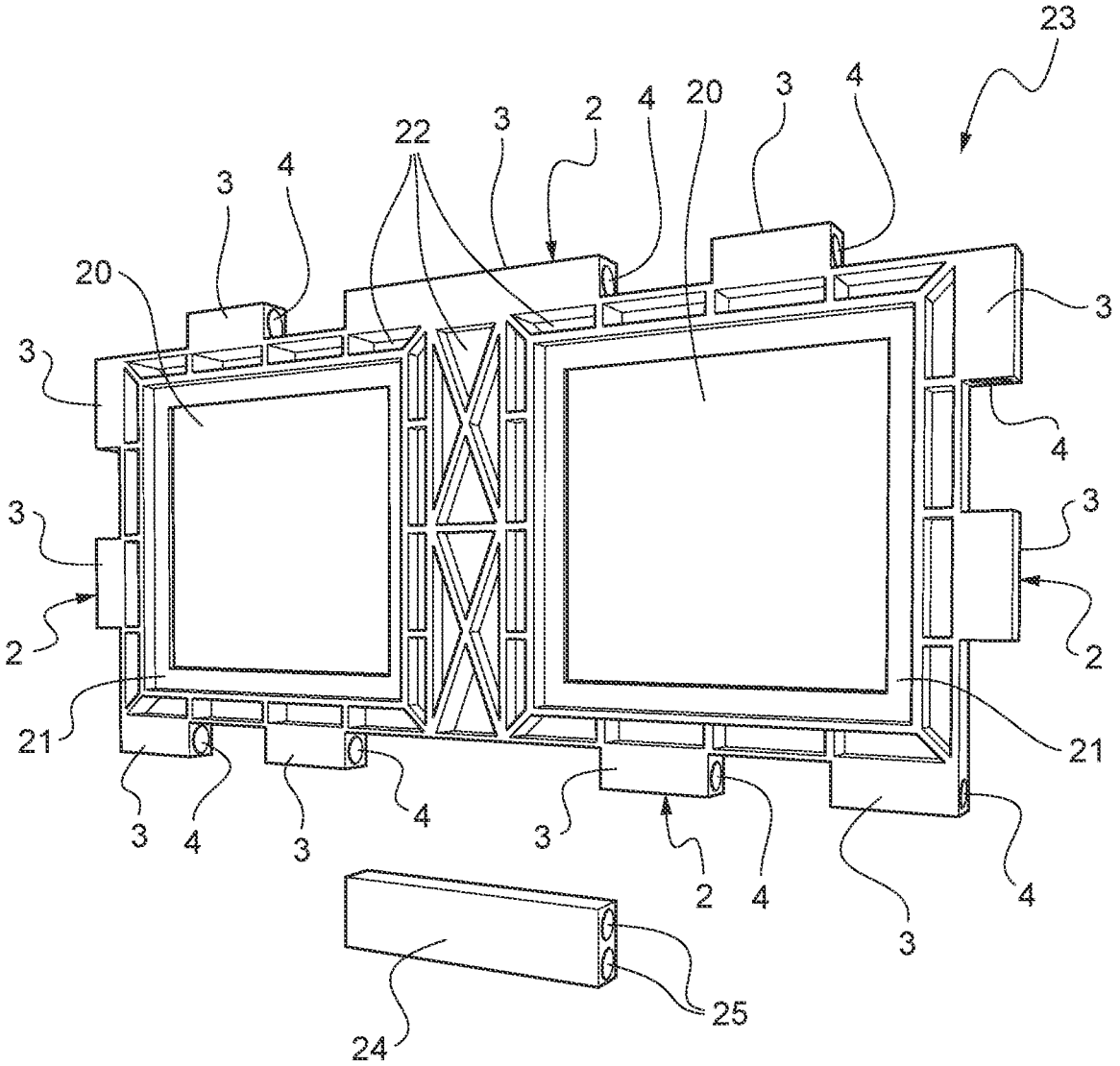
Figure 11:
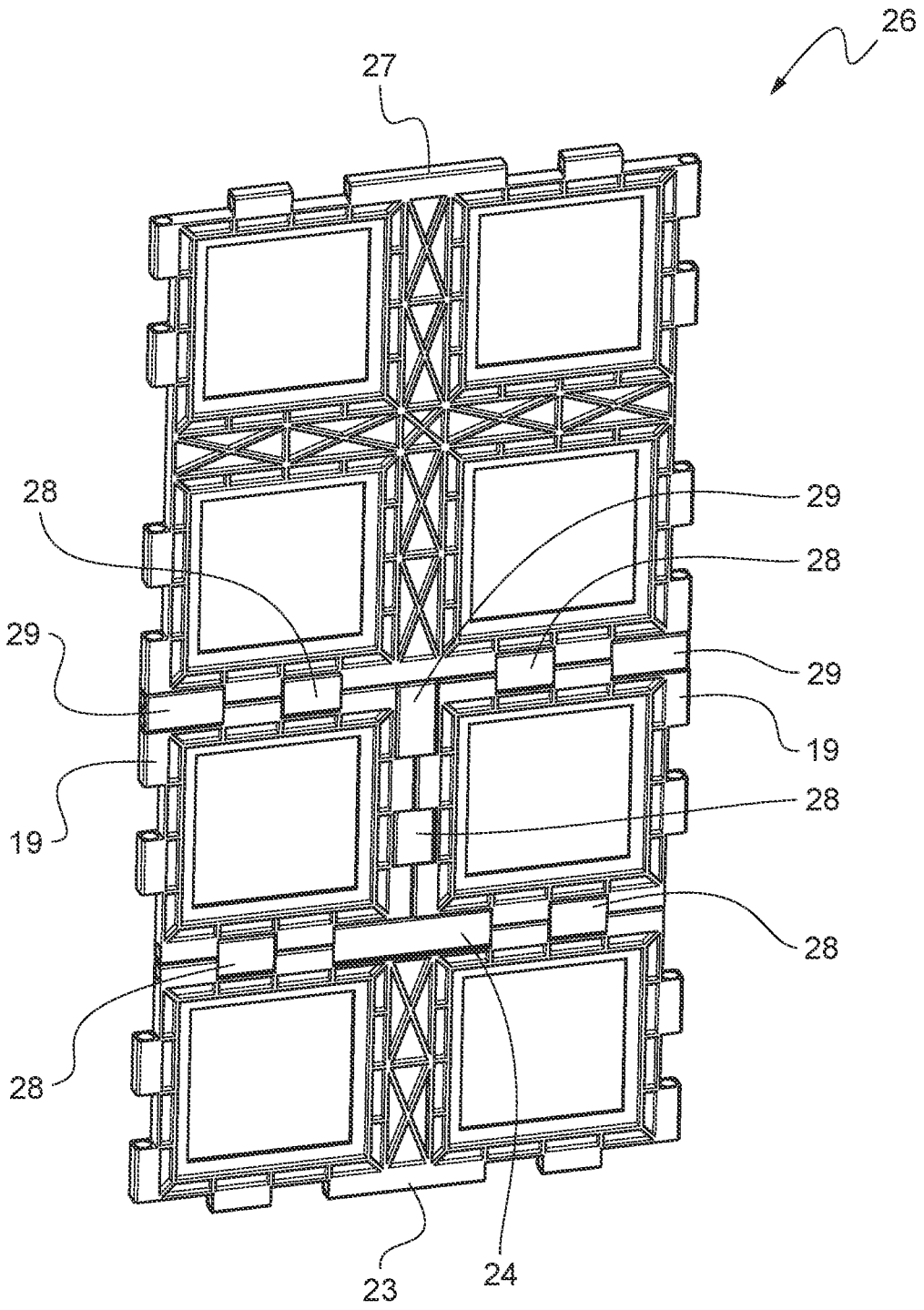
Figure 12:
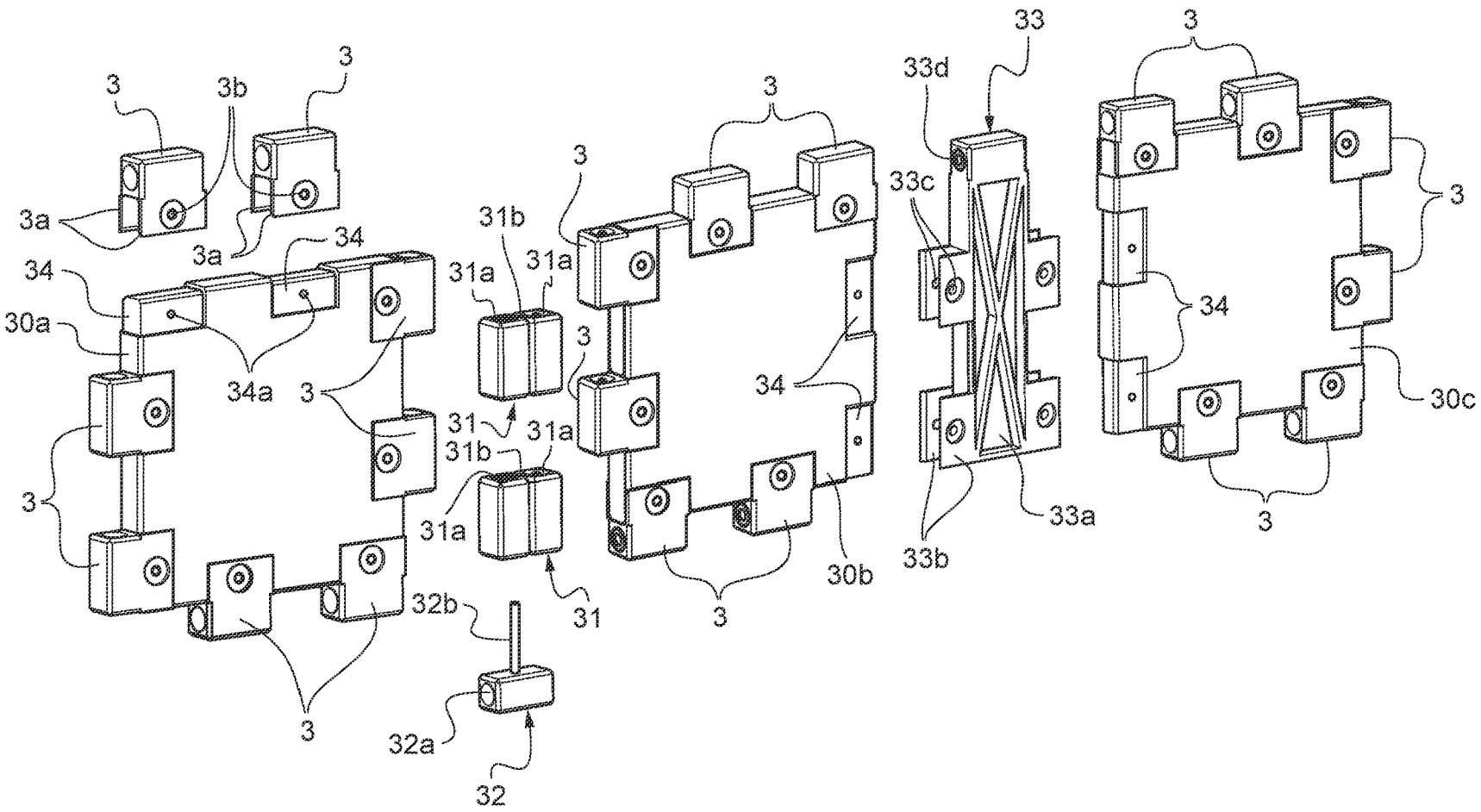
Figure 13:
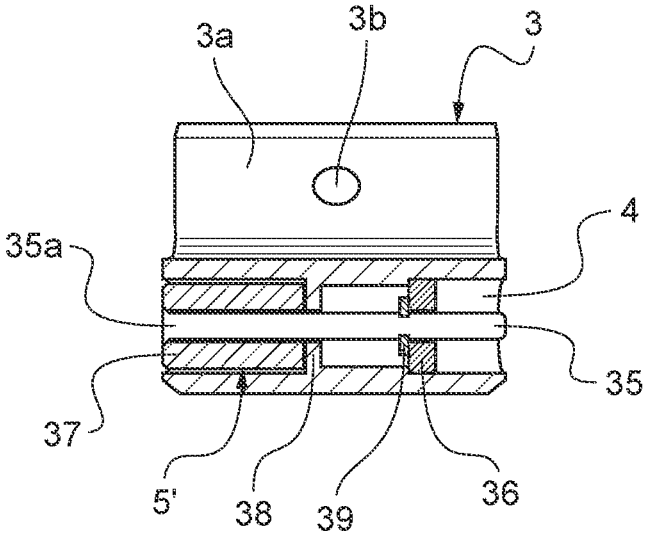
Figure 14:
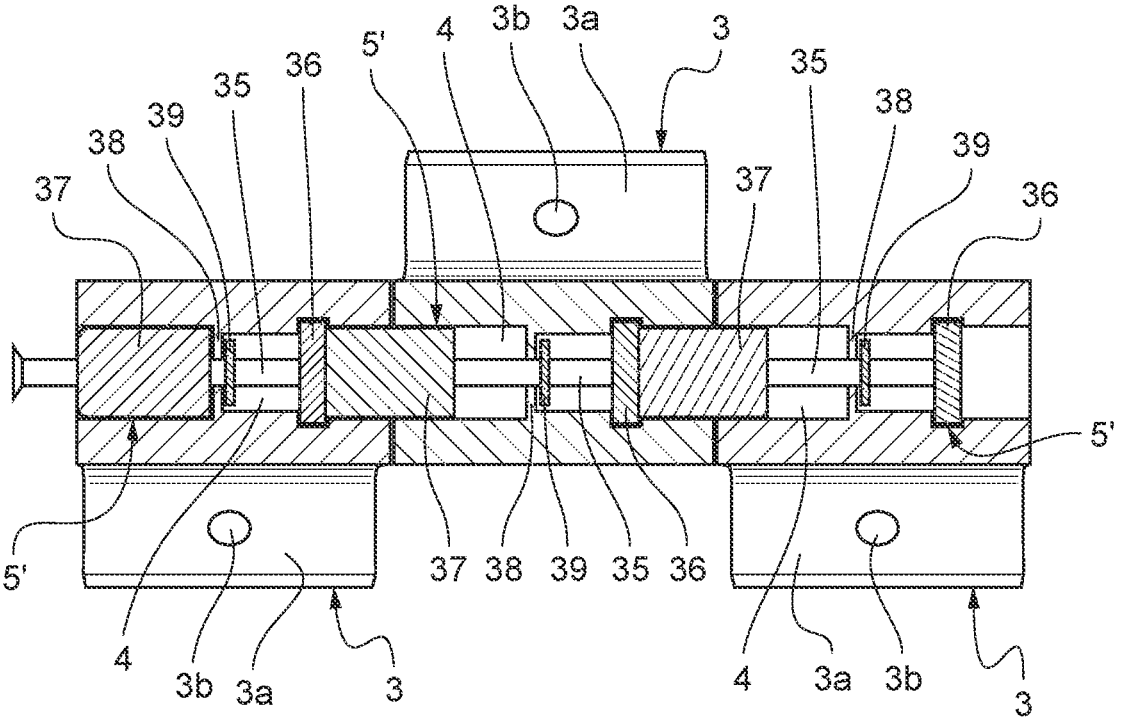
Figure 15:
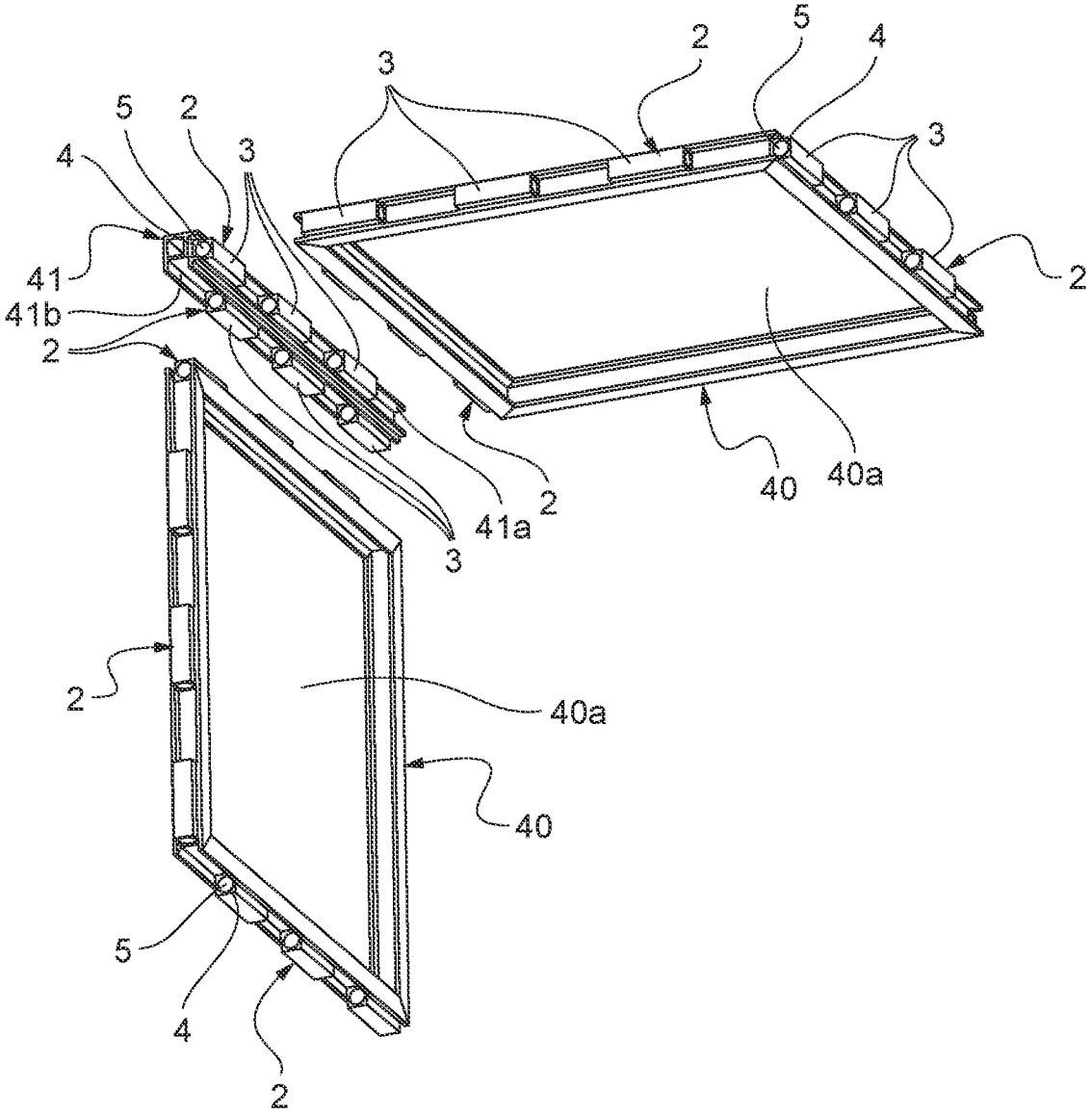
Figure 16:
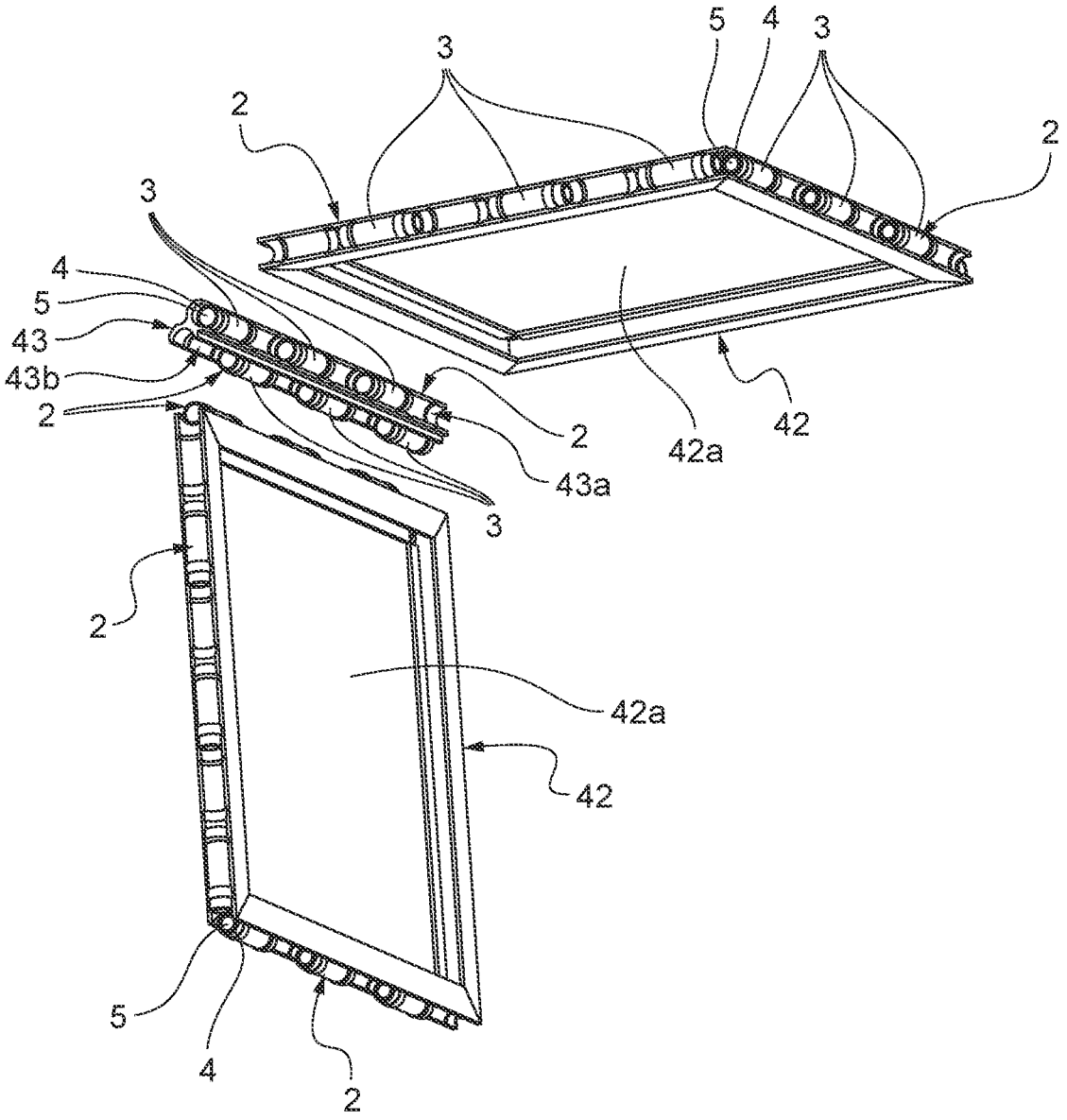

FIG. 5*a* is a sectional view of two interconnected edges of two panels of FIG. 1, when the sliding locking devices of the two panels are in the unlocked position;

FIG. 5*b* is a sectional view of two interconnected edges of two panels of FIG. 1, when the sliding locking devices of the two panels are in the locked position;

FIG. 6 is a perspective view of an elongated body of a sliding locking device according to one particular embodiment of the present invention;

FIG. 7 is a perspective view of the sliding locking device of FIG. 6 in the unlocked position;

FIG. 8 is a perspective view of the sliding locking device of FIG. 6 in the locked position;

FIG. 9 is a perspective view of a panel according to a second embodiment of the present invention;

FIG. 10 is a perspective view of a panel and of an additional connecting part according to a third embodiment of the present invention;

FIG. 11 is a perspective view of a panel assembly made up of an assembly of several panels and several additional connecting parts according to the present invention;

FIG. 12 is a perspective view of panels, additional connecting parts and an additional junction part according to a fourth embodiment of the present invention;

FIG. 13 is a sectional view of a protrusion of a panel of FIG. 12, when the sliding locking device is in the unlocked position;

FIG. 14 is a sectional view of two interconnected edges of two panels of FIG. 12, when the sliding locking devices are in the locked position;

FIG. 15 is a perspective view of two panels and of an additional corner part according to a fifth embodiment of the present invention; and FIG. 16 is a perspective view of two panels and of an additional corner part according to a sixth embodiment of the invention.

Figure 2:
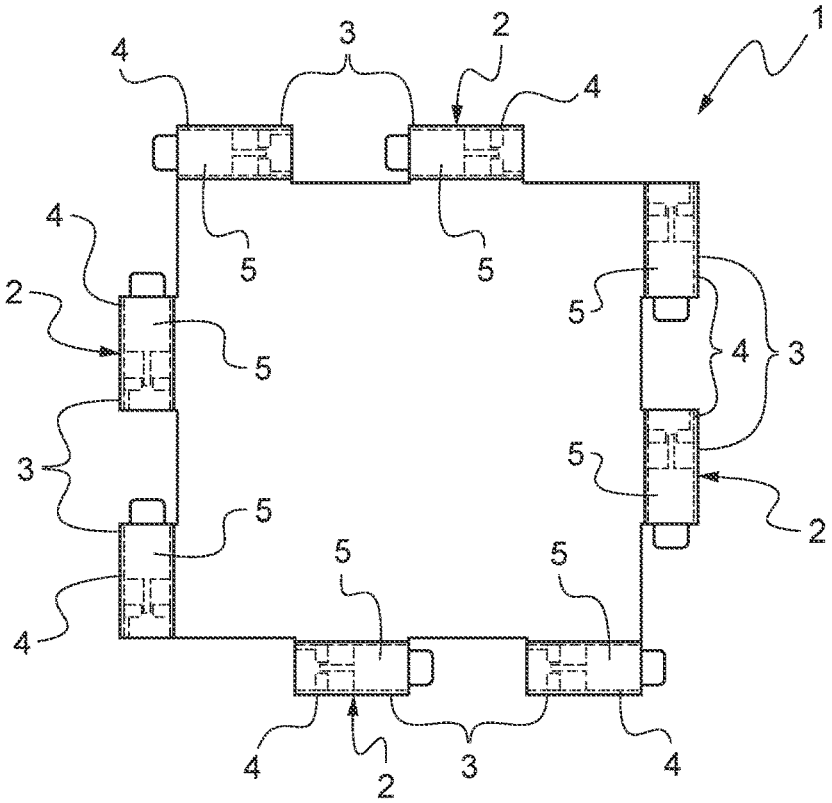
FIG. 2 is a front view of the panel of FIG. 1 when the sliding locking devices of the panel are in the locked position.

FIGS. 1 and 2 show a construction panel 1 according to a first embodiment of the present invention.

The panel 1 has a square shape, but could also have any other convex polygonal shape, such as a rectangle, a triangle, a diamond, a hexagon or a pentagon, without departing from the scope of the present invention.

The panel 1 is made from plastic material such as acrylonitrile-butadiene-styrene (ABS) plastic, polystyrene or polyethylene terephthalate (PET) plastic, but could also be made from metal, such as aluminum or steel, from wood or from cardboard, without departing from the scope of the present invention.

Each of the four edges of the panel 1 has, over its entire length, a crenelated pattern 2 made up of two protrusions 3.

It should be noted that the crenelated patterns 2 could also comprise any number of protrusions 3, without departing from the scope of the present invention.

For each crenelated pattern 2, the distance separating the two protrusions 3 is identical to the length of the protrusions 3. The empty space between the two protrusions 3 can thus receive a protrusion 3 of another panel 1. Each crenelated pattern 2 of the panel 1 can thus be interconnected with a crenelated pattern 2 of another panel 1.

In the particular embodiment shown in FIGS. 1 and 2, the length of the protrusions 3 is equal to one quarter of the length of the side of the panel 1. However, the length of the protrusions 3 could also be greater than or less than one quarter of the length of the side of the panel 1, without departing from the scope of the present invention, the only constraint being that the crenelated pattern 2 is complementary to another crenelated pattern 2 of another panel 1.

A longitudinal through bore 4 with a circular section is arranged in each protrusion 3 of the panel 1.

The elements present inside the longitudinal through bores 4 have been shown in dotted lines in FIGS. 1 and 2.

A sliding locking device 5 is positioned in each longitudinal through bore 4 of the panel 1.

Each sliding locking device 5 has a length identical to that of the associated longitudinal through bore 4 and can take either an unlocked position (as shown in FIG. 1) in which the sliding locking device 5 is completely withdrawn inside the associated longitudinal through bore 4, or a locked position (as shown in FIG. 2) in which the sliding locking device 5 partially leaves the associated longitudinal through bore 4.

The structure of the sliding locking device 5 will be described in more detail in FIGS. 5*a* and 5*b*.

Figure 3:
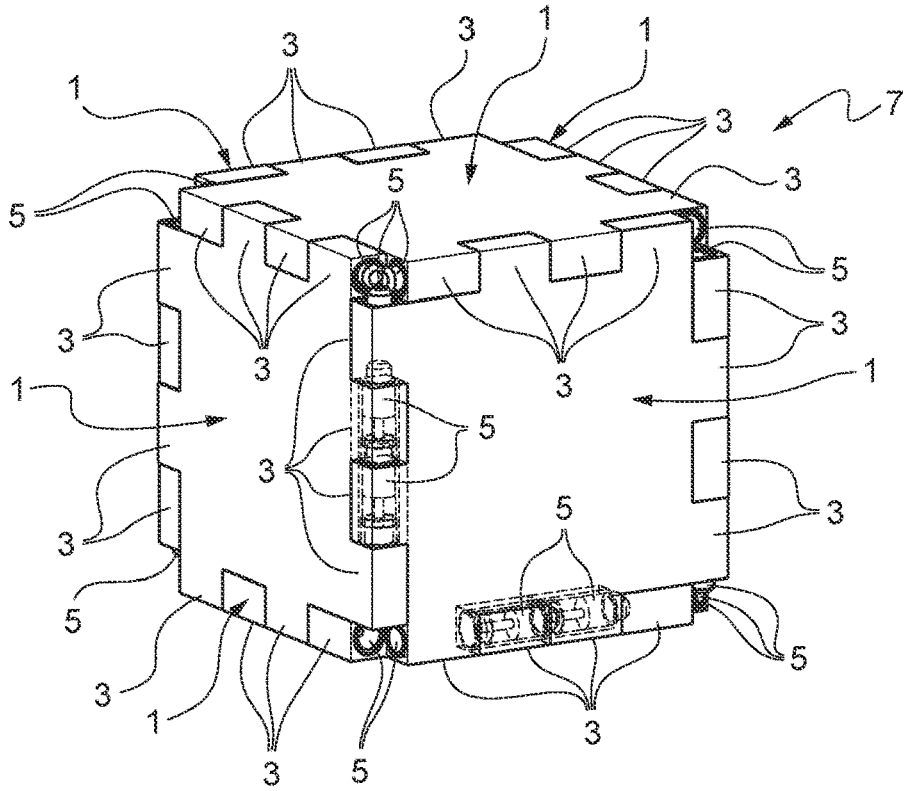
FIG. 3 is a perspective view of a first modular packaging item made using panels of FIG. 1.

FIG. 3 shows a modular packaging item 7 in a cubic bin shape made using six panels 1.

It should be noted that the panels 1 could also be used to build another type of modular object such as a furniture item or a partition, without departing from the scope of the present invention.

Each of the six sides of the modular packaging item 7 is made using a panel 1.

The modular packaging item 7 is made by interconnecting the crenelated edges of the six panels 1 two by two so as to form the ridges of the modular packaging item 7.

All of the sliding locking devices 5 of the modular packaging item 7 are placed in the locked position. Some of the sliding locking devices 5, which are normally not visible, have been shown in dotted lines in FIG. 3.

When a first crenelated pattern 2 of a first panel 1 is interconnected with a complementary second crenelated pattern 2 of a second panel 1 so as to form a ridge of the modular packaging item 7, during the passage to the locked position, each sliding locking device 5 of the first and second crenelated patterns 2 partially withdraws into the longitudinal through bore 4 of the adjacent protrusion 3 of the other panel and pushes the sliding locking device 5 of said adjacent protrusion 3 of the other panel 1, which makes it possible to perform serial locking.

Since the sliding locking devices 5 of a same crenelated edge are configured to slide in the same direction to go from the unlocked position to the locked position, all of the sliding locking devices 5 of one edge interconnected with the edge of another panel 1 can thus be moved simultaneously by a single operator gesture, thus preventing a multitude of locking actions.

The sliding locking devices 5 integrated into the panels 1 thus make it possible to facilitate the locking/unlocking of the ridges of the modular packaging 7.

In order to lock a ridge of the modular packaging item 7, the user will thus must push the sliding locking device 5 located at one of the ends of said ridge in order to drive the sliding of all of the sliding locking devices 5 of said ridge, each sliding locking device 5 entering the adjacent protrusion 3 of said ridge and pushing the locking device 5 present in the adjacent protrusion 3.

Likewise, in order to unlock the ridge of the modular packaging item 7, the user will simply must push the sliding locking device 5 located at the other end of said ridge in order to drive the sliding, in the opposite direction, of all of the sliding locking devices 5 of said ridge, said sliding locking device 5 then completely withdrawing into its own protrusion 3.

The height of the protrusions 3 of each panel 1 is equal to the thickness of the panel 1, which makes it possible to obtain 90° corner-shaped ridges.

Figure 4:
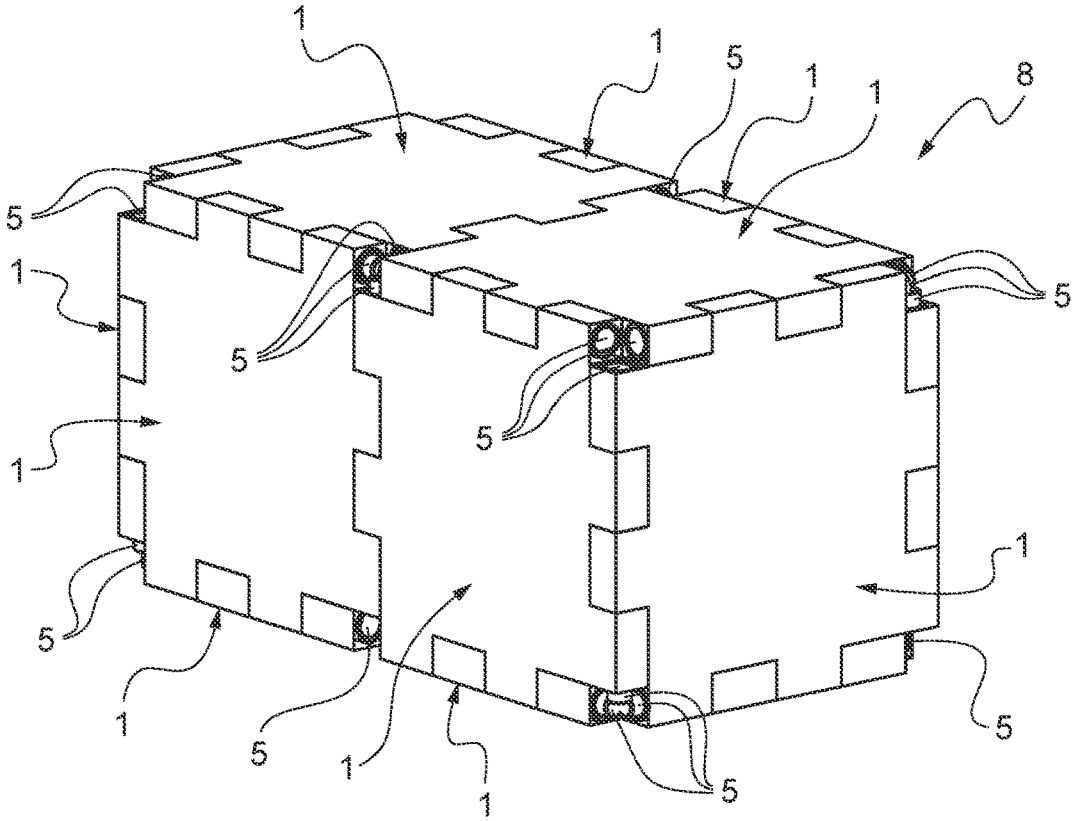
FIG. 4 is a perspective view of a second modular packaging item made using panels of FIG. 1.

As an example, the panels 1 of the modular packaging item 7 could have dimensions of 20 cm×20 cm or of 40 cm×40 cm. FIG. 4 shows another modular packaging item 8 in a parallelepipedal bin shape made using ten panels 1.

In this other example, two crenelated edges of two panels 1 are nested in the same plane so as to form the upper face of the modular packaging item 8, two crenelated edges of two other panels 1 are nested in the same plane so as to form the lower face of the modular packaging item 8, two crenelated edges of two other panels 1 are nested in the same plane so as to form a side face of the modular packaging item 8, and two crenelated edges of two other panels 1 are nested in the same plane so as to form another side face of the modular packaging item 8.

Then, the crenelated edges of the panels 1 are interconnected two by two so as to form the ridges of the parallelepipedal-shape modular packaging item 8, and all of the sliding locking devices 5 are placed in the locked position.

FIGS. 5*a* and 5*b* show a crenelated edge of a panel 1 interconnected with a crenelated edge of another panel 1.

Each sliding locking device 5 comprises a substantially cylindrical elongated body 9 able to slide in the longitudinal through bore 4 of the associated protrusion 3.

The elongated body 9 comprises a first end carrying a first metal element 10 and a second end carrying a second metal element 11.

Each sliding locking device 5 further comprises a rod 12 extending axially from the first end of the elongated body 9. An annular magnet 13 is positioned fixedly in the longitudinal through bore 4 of the associated protrusion 3 and is passed through by the rod 12 of the associated sliding locking device 5 such that, in the unlocked position (as shown in FIG. 5*a*), each elongated body 9 is located entirely in the longitudinal through bore 4 of the associated protrusion 3 and the first metal element 10 carried by the first end of the elongated body 9 is in contact with and retained by the annular magnet 13, and in the locked position (as shown in FIG. 5*b*) obtained by pushing the rod 12 of the leftmost sliding locking device 5 to the right, the second end of the elongated body 9 is outside the longitudinal through bore 4 of the associated protrusion 3 and the second metal element 11 carried by the second end of the elongated body 9 is in contact with and retained by the annular magnet 13 of the longitudinal through bore 4 of the adjacent protrusion 3, which allows the locking of the two crenelated edges of the two panels 1.

Each magnet 13 is designed so as to no longer keep retained the sliding locking device 5 when the latter is stressed by being pushed by the user or by another sliding locking device 5.

The first and second metal elements 10, 11 carried by the first and second ends of the elongated body 9 can, for example, be metal washers.

When all of the sliding locking devices 5 are in the unlocked position (that is to say when the first end of each elongated body 9 is retained by the magnet 13 of the associated protrusion 3, as shown in FIG. 5*a*), in order to lock the assembly, the user must push the accessible rod 12 of the sliding locking device 5 located at one of the ends of said assembly, such that the second end of each elongated body 9 will enter the adjacent protrusion 3 and will be retained by the magnet 13 of the adjacent protrusion 3, except for the second end of the last elongated body 9, which will leave its protrusion 3 and will thus be accessible by the user (as shown in FIG. 5*b*).

The user will then simply need to press on this accessible second end of the last elongated body 9 in order to unlock the assembly.

It should be noted that a pin could also be used as retaining mechanism in place of the magnet 13, without departing from the scope of the present invention.

FIG. 6 shows the moving part of the sliding locking device according to one particular embodiment of the present invention.

In this particular embodiment, the elongated body 9 carries peripheral longitudinal fins 14, said fins 14 allowing the guiding of the elongated body 9 in the associated longitudinal through bore 4.

The elongated body 9 further comprises a peripheral recess 15 arranged between the first metal element 10 and the fins 14, said peripheral recess 15 making it possible to limit the travel of the elongated body 9, as will be described in more detail in FIGS. 7 and 8.

Lastly, the second end of the elongated body 9 carrying the second metal element 11 has a tapered shape 16.

FIGS. 7 and 8 show the sliding locking device 5 according to the particular embodiment of the invention.

The sliding locking device 5 further comprises a stop ring 17 positioned fixedly in the longitudinal through bore 4 of the associated protrusion 3, at the peripheral recess 15 arranged in the elongated body 9, said stop ring 17 making it possible to limit the travel of the elongated body 9 in the associated longitudinal through bore 4.

In FIG. 7, the sliding locking device 5 is in the unlocked position and the fins 14 are abutting against the ring 17. On the contrary, in FIG. 8, the sliding locking device 5 is in the locked position and the first metal element 10 is abutting against the ring 17. The ring 17 thus makes it possible to limit the travel of the elongated body 9 between the unlocked position and the locked position.

The sliding locking device 5 further comprises a cylinder 18 fitted in the longitudinal through bore 4 of the associated protrusion 3, said cylinder 18 containing the annular magnet 13 at one of its ends and being flared at the other of its ends.

Positioning the magnet 13 at one of the ends of the cylinder 18 makes it possible to fix the position of the magnet 13 inside the longitudinal through bore 4 of the associated protrusion 3.

The length of the cylinder 18 is identical to that of the rod 12 of the sliding locking device 5, such that, when the first metal element 10 is in contact with the magnet 13, the free end of the rod 12 is at the outlet of the flared end of the cylinder 18.

The flared end of the cylinder 18 makes it possible to facilitate the insertion of the tapered second end 16 of the elongated body 9 of another sliding locking device 5 into the cylinder 18.

FIG. 9 shows a construction panel 19 according to a second embodiment of the present invention.

Like elements between the first embodiment of the invention in FIGS. 1 to 8 and this second embodiment of the invention have the same reference number, except for the panel which has reference number 19, and will not be described in more detail here when they have identical structures.

The panel 19 according to the second embodiment is identical to the panel 1 according to the first embodiment, except that it further has a central opening 20 arranged in its thickness.

The opening 20 has a square shape, for example of 14 cm×14 cm, but could also have any other shape, without departing from the scope of the present invention.

The opening 20 further has a border 21 for allowing a fastening element (not shown in FIG. 9) to be affixed thereupon around the opening 20, said fastening element allowing a covering (not shown in FIG. 9) to be fixed facing the opening 20.

The fastening element can for example be at least one adhesive strip, such as a strip with hooks and loops (Velcro® strip).

The covering can for example be at least one from among a protective foam, a plastic plate, a cardboard plate, a plexiglass plate and an information signage plate. The covering can also comprise a digital interface.

The panel 19 further comprises several indentations 22 arranged around the border 21, these indentations 22 being due to the manufacturing of the panel 19 by three-dimensional printing. The panel 19 could also not comprise these indentations 22, without departing from the scope of the present invention.

FIG. 10 shows a panel 23 and an additional connecting part 24 according to a third embodiment of the present invention. Like elements between the second embodiment of the invention in FIG. 9 and this third embodiment of the invention have the same reference number, except for the panel which has reference number 23, and will not be described in more detail here when they have identical structures.

Unlike the panel 19 which has a square shape, the panel 23 has a rectangular shape, for example of 20 cm×40 cm. Furthermore, unlike the panel 19 which has a single opening 20, the panel 23 has two openings 20.

The crenelated pattern 2 of the upper edge of the panel 23 is made up of three protrusions 3, the central protrusion 3 being longer than the two other protrusions 3.

The crenelated pattern 2 of the lower edge of the panel 23 is made up of four protrusions 3 of the same length, the space separating the two central protrusions 3 having the same length as the central protrusion 3 of the crenelated pattern 2 of the upper edge of the panel 23, such that the crenelated pattern 2 of the lower edge of the panel 23 is complementary to that of the upper edge of the panel 23.

Thus, the crenelated pattern 2 of the lower edge of the panel 23 can be interconnected with the crenelated pattern 2 of the upper edge of another panel 23.

The sliding locking device 5 of the longest central protrusion 3 of the crenelated pattern 2 of the upper edge of the panel 23 is longer than the other sliding locking devices 5 of the panel 23 and has a length identical to that of said longest central protrusion 3 of the crenelated pattern 2 of the upper edge of the panel 23.

The additional connecting part 24 is designed to be inserted between two crenelated patterns 2 of two adjacent panels 23 so as to allow the assembly of the two adjacent panels 23 in the same plane.

The additional connecting part 24 has a parallelepipedal shape whose length is identical to that of the longest central protrusion 3 of the upper edge of the panel 23, whose thickness is identical to that of the panel 23, and whose height is equal to twice that of the protrusions 3 of the panel 23.

Half of the additional connecting part 24 can thus be inserted into the space separating the two central protrusions 3 of the lower edge of the panel 23.

The additional connecting part 24 has two parallel longitudinal through bores 25 each comprising a sliding locking device 5 which is similar to those present in the protrusions 3 of the panel 23, so as to allow the locking of the additional connecting part 25 in the crenelated pattern 2 of the lower edge of the panel 23.

FIG. 11 shows a panel assembly 26 as an example made up of an assembly of several panels 19, 23, 27 and several additional connecting parts 24, 28, 29.

The panel 27 is another possible type of panel that has a square shape, the surface of which corresponds to twice that of the panel 23, four openings 20 being arranged in the panel 27.

The additional connecting parts 28 have a length equal to one third of that of the additional connecting part 24, and the additional connecting parts 29 have a length equal to half of that of the additional connecting part 24.

The two panels 19 are joined to one another without interconnecting of the crenelated patterns 2 by inserting an additional connecting part 28 and an additional connecting part 29 between them.

The two panels 19 are abutting against an edge of the panel without interconnecting the crenelated patterns 2 by inserting two additional connecting parts 28 and two additional connecting parts 29 between them.

Lastly, the two panels 19 are abutting against an edge of the panel 23 without interconnecting the crenelated patterns 2 by inserting an additional connecting part 24 and two additional connecting parts 28 between them.

Thus, the additional connecting parts 24, 28, 29 make it possible to join the panels 19, 23, 27 in the same plane without interconnecting their crenelated patterns 2, the sliding locking devices 5 which are present in the protrusions 3 of the panels 19, 23, 27 and in the additional connecting parts 24, 28, 29 allowing the locking of the assembly.

FIG. 12 shows three panels 30*a*, 30*b*, 30*c*, additional connecting parts 31 and 32 and an additional junction part 33 according to a fourth embodiment of the present invention.

In this fourth embodiment, the protrusions 3 are elements removably fixed by screwing on the edges of each of the panels 30*a*, 30*b*, 30*c*.

In FIG. 12, the two upper protrusions 3 of the panel 30*a* have been shown unassembled, and the right edge of the panel 30*b* and the left edge of the panel 30*c* have been shown with no protrusions.

Each protrusion 3 has two parallel nesting wings 3*a* which are able to nest on the corresponding edge of the panel 30*a*, 30*b*, 30*c* at a nesting recess 34.

Each protruding nesting wing 3*a* has a through hole 3*b*, and each panel nesting recess 34 also has a through hole 34*a*, so as to allow the protrusions 3 to be fixed on the panels 30*a*, 30*b*, 30*c* by screwing.

It should be noted that the protrusions 3 could also be fixed by riveting or gluing, without departing from the scope of the present invention.

The two panels 30*a* and 30*b* are able to be joined against one another without interconnection of the protrusions 3 by inserting additional connecting parts 31 and 32 between them.

The two additional connecting parts 31 have a substantially parallelepipedal shape having two parallel longitudinal through bores 31*a* each comprising a sliding locking device (not visible in FIG. 12), so as to allow the locking of the additional connecting parts 31 in the protrusions 3 of the right edge of the panel 30*a* and of the left edge of the panel 30*b*.

The additional connecting part 32 has a parallelepipedal shape having a longitudinal through bore 32*a* comprising a sliding locking device (not shown in FIG. 12). The additional connecting part 32 further comprises a rod 32*b* extending from the parallelepipedal shape perpendicular to the longitudinal through bore 32*a*, said rod 32*b* being able to be inserted in a hole 31*b* formed between the two longitudinal through bores 31*a* of the additional connecting part 31, said hole 31*b* being parallel to the two longitudinal through bores 31*a*. The sliding locking device of the additional connecting part 32 thus allows the locking of the additional connecting part 32 in the protrusions 3 of the lower edges of the panels 30*a* and 30*b*. The additional connecting parts 31 and 32 thus allow the connection of the two panels 30*a* and 30*b* in the same plane.

It should be noted that the part 32 could also be formed in a single piece with the part 31, without departing from the scope of the present invention.

Furthermore, the two panels 30*b* and 30*c* can be joined against one another using the additional junction part 33.

The additional junction part 33 has a parallelepipedal body 33*a* from which pairs of parallel nesting wings 33*b* extend, each pair of parallel nesting wings 33*b* being able to nest on a nesting recess 34 of one of the edges with no protrusion of the panels 30*b* and 30*c*. Each nesting wing 33*b* comprises a through hole 33*c* to allow the fixing by screwing of the additional junction part 33 on the panels 30*b* and 30*c*. The additional junction part 33 thus allows the assembly of the two adjacent panels 30*b* and 30*c* in the same plane.

The parallelepipedal body 33*a* of the additional junction part 33 further has, in the upper part, a longitudinal through bore 33*d* comprising a sliding locking device (not visible in FIG. 12). The sliding locking device of the additional junction part 33 thus allows the locking of the additional junction part 33 in the protrusions 3 of the upper edges of the panels 30*b* and 30*c*.

The additional connecting parts 31, 32 and the additional junction part 33 thus make it possible to assemble the panels 30*a*, 30*b*, 30*c* in the same plane so as to form a larger panel. FIGS. 13 and 14 show a sliding locking device 5' according to the fourth embodiment.

The sliding locking device 5' comprises a movable rod 35 whose length is identical to that of the longitudinal through bore 4 of the associated protrusion 3.

The sliding locking device 5' further comprises, as retaining mechanism, a first annular magnet 36 which is positioned fixedly in the longitudinal through bore 4 of the associated protrusion 3 and passed through by the movable rod 35. The sliding locking device 5' further comprises a second annular magnet 37 which is mounted slidingly on the movable rod 35, the end 35*a* of the movable rod 35 on the side of the second annular magnet 37 being flared so as to prevent the disengagement of the second annular magnet 37.

The sliding locking device 5' further comprises a stop 38 which is positioned fixedly in the longitudinal through bore 4 of the associated protrusion 3 and passed through by the movable rod 35, so as to limit the travel of the second annular magnet 37 in the longitudinal through bore 4.

The movable rod 35 carries a stop washer 39 which is located between the stop 38 and the first annular magnet 36, so as to limit the travel of the movable rod 35 in the longitudinal through bore 4.

The face of the second annular magnet 37 on the side of the flared end 35*a* is positively biased, while the face of the second annular magnet 37 on the side of the stop 38 is negatively biased. Likewise, the face of the first annular magnet 36 on the side of the stop 38 is positively biased, while the other opposite face of the first annular magnet 36 is negatively biased.

Thus, in the unlocked position as shown in FIG. 13, the movable rod 35 is fully in the longitudinal through bore 4 of the associated protrusion 3, the stop washer 39 is abutting against the first annular magnet 36, and the second annular magnet 37 is sandwiched between the flared end 35*a* of the movable rod 35 and the stop 38.

Furthermore, in the locked position as shown in FIG. 14, the stop washer 39 is against the stop 38, and part of the second annular magnet 37 is outside the longitudinal through bore 4 of the associated protrusion 3 and is configured to be attracted, by magnetic attraction, by the first annular magnet 36 of the longitudinal through bore 4 of the following protrusion 3 of the panel edge interconnection.

The sliding locking device 5' according to this fourth embodiment thus makes it possible to obtain automatic linear locking by magnetic attraction. Indeed, when the protrusions 3 of two crenelated edges of two panels are interconnected, the second annular magnets 37 are automatically attracted by the first annular magnets 36 of the following protrusions 3 and come into contact against them, the second annular magnets 37 also moving their associated movable rods 35 during their movement. The second annular magnet 37 of the last protrusion 3 of the interconnection (on the left in FIG. 14) remains immobile given that it does not have an adjacent first annular magnet 36, the movable rod 35 of this last protrusion 3 partially leaving its protrusion 3 by being pushed by the movable rod 35 of the preceding protrusion 3. The locking is permanent until human intervention through pressure on the flared end 35*a* of the movable rod 35 of this last protrusion 3 of the interconnection. In this case, the flared ends 35*a* of the other movable rods 35 allow a return of the second annular magnets 37 to their unlocked position. FIG. 15 shows two panels 40 and an additional corner part 41 according to a fifth embodiment of the present invention. Each of the two panels 40 has a square shape having a central opening 40*a*, said central opening 40*a* being able to receive any type of walls.

Each of the edges of the two panels 40 has a groove with a rectangular section in which a crenelated pattern 2 is formed comprising three parallelepipedal protrusions 3, each protrusion 3 comprising a longitudinal through bore 4 in which a sliding locking device 5 or 5' is positioned.

The additional corner part 41 has a substantially square cross-section.

Two adjacent faces 41*a* and 41*b* of the additional corner part 41 each have a groove with a rectangular section in which a crenelated pattern 2 is formed comprising three parallelepipedal protrusions 3 in each of which a longitudinal through bore 4 is formed in which a sliding locking device 5 or 5' is positioned.

The face 41*a* with crenelated pattern of the additional corner part 41 can thus interconnect with one of the edges with complementary crenelated pattern of one of the panels 40, the sliding locking devices 5 or 5' of said panel 40 and of said face 41*a* making it possible to lock the interconnection.

The face 41*b* with crenelated pattern of the additional corner part 41 can further interconnect with one of the edges with complementary crenelated pattern of the other of the panels 40, the sliding locking devices 5 or 5' of said panel 40 and of said face 41*b* making it possible to lock the interconnection.

The additional corner part 41 thus makes it possible to assemble the two panels 40 at a 90° angle.

It should be noted that the edges of the panels 40 and the faces 41*a* and 41*b* of the additional corner part 41 could also comprise any number of protrusions 3, without departing from the scope of the present invention.

Furthermore, the faces 41*a* and 41*b* of the additional corner part 41 could also be inclined relative to one another by an angle greater or less than 90°, without departing from the scope of the present invention.

Preferably, sealing gaskets (not shown in FIG. 15) are positioned on the upper parts of the grooves of the edges of the panels 40 and/or of the grooves of the faces 41*a* and 41*b* of the additional corner part 41, so as to seal the final assembled container.

FIG. 16 shows two panels 42 and an additional corner part 43 according to a sixth embodiment of the present invention. Each of the two panels 42 has a square shape having a central opening 42*a*, said central opening 42*a* being able to receive any type of walls.

Each of the edges of the two panels 42 has a groove with a semicircular section in which a crenelated pattern 2 is formed comprising three cylindrical protrusions 3, each protrusion 3 comprising a longitudinal through bore 4 in which a sliding locking device 5 or 5' is positioned.

The additional corner part 43 has two adjacent, perpendicular faces 43*a* and 43*b*.

Each of said two adjacent faces 43*a* and 43*b* of the additional corner part 43 has a groove with a semicircular section in which a crenelated pattern 2 is formed comprising three cylindrical protrusions 3 in each of which a longitudinal through bore 4 is formed in which a sliding locking device 5 or 5' is positioned.

The face 43*a* with crenelated pattern of the additional corner part 43 can thus interconnect with one of the edges with complementary crenelated pattern of one of the panels 42, the sliding locking devices 5 or 5' of said panel 42 and of said face 43*a* making it possible to lock the interconnection.

The face 43*b* with crenelated pattern of the additional corner part 43 can further interconnect with one of the edges with complementary crenelated pattern of the other of the panels 42, the sliding locking devices 5 or 5' of said panel 42 and of said face 43*b* making it possible to lock the interconnection.

The additional corner part 43 thus makes it possible to assemble the two panels 42 at a 90° angle.

It should be noted that the edges of the panels 42 and the faces 43*a* and 43*b* of the additional corner part 43 could also comprise any number of protrusions 3, without departing from the scope of the present invention.

Furthermore, the two faces 43*a* and 43*b* of the additional corner part 43 could also be inclined relative to one another by an angle greater or less than 90°, without departing from the scope of the present invention.

Preferably, sealing gaskets (not shown in FIG. 16) are positioned on the upper parts of the grooves of the edges of the panels 42 and/or of the grooves of the faces 43*a* and 43*b* of the additional corner part 43, so as to seal the final assembled container.

It should be understood that the particular embodiments that have been described above were given for illustrative purposes and non-limitingly, and that changes can be made thereto without departing from the scope of the present invention.

The invention claimed is:

1. A construction panel, wherein the construction panel has a polygonal shape, an entire length of each edge of the construction panel having a crenelated pattern made up of at least two protrusions, a longitudinal through bore being arranged in each of the at least two protrusions, wherein, for each of the at least two protrusions, a sliding locking device is positioned in an associated longitudinal through bore, the sliding locking device and the associated longitudinal through bore having the same length, the sliding locking device being able to assume one of an unlocked position in which the sliding locking device is completely located inside the associated longitudinal through bore and a locked position in which the sliding locking device partially leaves the associated longitudinal through bore, wherein, for each edge of the construction panel, each sliding locking device of a corresponding crenelated pattern is configured to slide in the same direction to pass from the unlocked position to the locked position such that, when one crenelated pattern of the construction panel is interconnected with a complementary crenelated pattern of an edge of another construction panel, during passage to the locked position, each sliding locking device of the one crenelated pattern is configured to partially enter a longitudinal through bore of an adjacent protrusion of the another construction panel and to push a sliding locking device of the adjacent protrusion of the another construction panel.

2. The construction panel according to claim 1, wherein the construction panel, excluding each crenelated pattern, has one of a square and a rectangular shape, a height of the at least two protrusions of each crenelated pattern being equal to a thickness of the construction panel.

3. The construction panel according to claim 1, wherein the at least two protrusions of each crenelated pattern are fixed removably on a corresponding edge of the construction panel.

4. The construction panel according to claim 1, wherein each protrusion of the at least two protrusions has a magnet or pin configured to retain the sliding locking device in one of the unlocked position and the locked position.

5. The construction panel according to claim 4, wherein the sliding locking device comprises an elongated body able to slide in the longitudinal through bore of an associated protrusion of the at least two protrusions, the elongated body comprising a first end carrying a first metal element and a second opposite end carrying a second metal element, the sliding locking device further comprising a rod extending axially from the first end of the elongated body, the retaining mechanism being an annular magnet positioned fixedly in the longitudinal through bore of the associated protrusion of the at least two protrusions and passed through by the rod such that, in the unlocked position, the elongated body is located entirely in the longitudinal through bore of the associated protrusion of the at least two protrusions and the first metal element carried by the first end of the elongated body is in contact with the annular magnet, and in the locked position obtained by pushing said rod toward an inside of the longitudinal through bore, a second opposite end of the elongated body is located outside the longitudinal through bore of the associated protrusion of the at least two protrusions and the second metal element carried by the second opposite end of the elongated body is configured to be in contact with an annular magnet of a longitudinal through bore of an adjacent protrusion of another construction panel which is interconnected with the construction panel, the sliding locking device further comprising a stop positioned fixedly in the longitudinal through bore of the associated protrusion of the at least two protrusions, at a peripheral recess arranged in the elongated body so as to limit travel of the elongated body in the longitudinal through bore.

6. The construction panel according to claim 4, wherein the sliding locking device comprises a movable rod with a length identical to a length of the longitudinal through bore of an associated protrusion of the at least two protrusions, the retaining mechanism being a first annular magnet positioned fixedly in the longitudinal through bore of the associated protrusion of the at least two protrusions and passed through by the movable rod, a second annular magnet being mounted slidingly on the movable rod, an end of the movable rod on a side of the second annular magnet being flared so as to prevent disengagement of the second annular magnet, the sliding locking device further comprising a stop positioned fixedly in the longitudinal through bore of the associated protrusion of the at least two protrusions so as to limit travel of the second annular magnet in the longitudinal through bore, the movable rod carrying a stop washer which is located between the stop and the first annular magnet so as to limit travel of the movable rod in the longitudinal through bore, such that, in the unlocked position, the movable rod is located entirely in the longitudinal through bore of the associated protrusion of the at least two protrusions, the stop washer is abutting against the first annular magnet, and the second annular magnet is sandwiched between the flared end of the movable rod and the stop, and in the locked position, the stop washer is against the stop, and at least part of the second annular magnet is located outside the longitudinal through bore of the associated protrusion of the at least two protrusions and is configured to be attracted, by magnetic attraction, by a first annular magnet of a longitudinal through bore of an adjacent protrusion of another construction panel which is interconnected with the construction panel.

7. The construction panel according to claim 1, wherein the construction panel has at least one opening arranged in a thickness of the construction panel.

8. The construction panel according to claim 7, wherein the construction panel further comprises at least one fastening element positioned around the at least one opening and configured to allow the fastening of a covering facing the at least one opening.

9. The construction panel according to claim 1, wherein the construction panel is made from at least one material from among plastic, metal, wood and cardboard.

10. A kit for building a modular object, comprising a plurality of construction panels according to claim 1.

11. The kit according to claim 10, wherein the kit further comprises at least one additional connecting part which is arranged to be inserted into adjacent crenelated patterns of two adjacent construction panels of the plurality of construction panels so as to allow the assembly of the two adjacent construction panels in the same plane, the at least one additional connecting part having two parallel longitudinal through bores each comprising a sliding locking device.

12. The kit according to claim 11, wherein the at least one additional connecting part further has a third longitudinal through bore which is perpendicular to the two parallel longitudinal through bores, the third longitudinal through bore comprising a sliding locking device.

13. The kit according to claim 10, wherein the at least two protrusions of each crenelated pattern of the plurality of construction panels are fixed removably on a corresponding edge of the construction panel, wherein the kit further comprises at least one additional junction part arranged to nest into two adjacent edges with no protrusion of two adjacent construction panels of the plurality of construction panels, so as to allow assembly of the two adjacent construction panels in the same plane.

14. The kit according to claim 10, wherein the kit further comprises at least one additional corner part comprising two adjacent faces each including a crenelated pattern made up of at least two protrusions, a longitudinal through bore being arranged in each of the at least two protrusions, a sliding locking device being positioned in the longitudinal through bore, such that each of the two adjacent faces with crenelated pattern of the at least one additional corner part is configured to interconnect with an edge with complementary crenelated pattern of a construction panel of the plurality of the construction panels, so as to form a corner connection of two construction panels of the plurality of construction panels.

15. A modular object built using a kit according to claim 10.

* * * * *